US007798583B2

(12) United States Patent
Yang et al.

(10) Patent No.: US 7,798,583 B2
(45) Date of Patent: Sep. 21, 2010

(54) DETENT PIN BEARING RETAINER LOCK FOR A DRAWER SLIDE

(75) Inventors: Wenming Yang, Singapore (SG); Alfred E. Barry, Jr., Atlanta, GA (US)

(73) Assignee: Central Industrial Supply Company, Tuscon, AZ (US)

( * ) Notice: Subject to any disclaimer, the term of this patent is extended or adjusted under 35 U.S.C. 154(b) by 306 days.

(21) Appl. No.: 11/150,041

(22) Filed: Jun. 10, 2005

(65) Prior Publication Data

US 2006/0279187 A1 Dec. 14, 2006

(51) Int. Cl.
*A47B 88/04* (2006.01)

(52) U.S. Cl. ..... 312/334.46; 312/333

(58) Field of Classification Search ..... 312/333, 312/334.44–334.47, 334.7; 403/381, 80, 403/360, 319; 411/104, 522, 501, 2, 3, 5; 384/21

See application file for complete search history.

(56) References Cited

U.S. PATENT DOCUMENTS 3,356,401 A * 12/1967 Bertram ..... 52/506.05
3,738,716 A * 6/1973 Lambert ..... 384/18
3,904,254 A * 9/1975 Hagen et al. ..... 384/18
4,932,792 A * 6/1990 Baxter ..... 384/18
5,033,900 A * 7/1991 Pine ..... 403/162
5,181,782 A * 1/1993 Wojcik ..... 384/21
5,425,519 A * 6/1995 Budert ..... 248/214
5,466,069 A * 11/1995 Agari ..... 384/49
5,566,269 A * 10/1996 Eberle et al. ..... 385/137
6,244,678 B1 * 6/2001 Dopp et al. ..... 312/333
6,305,725 B1 * 10/2001 Antonucci et al. ..... 292/67
6,339,970 B1 * 1/2002 Blex ..... 74/492
6,435,790 B1 * 8/2002 Ichikawa ..... 411/349

* cited by examiner

*Primary Examiner*—Janet M Wilkens
*Assistant Examiner*—Matthew W Ing
(74) *Attorney, Agent, or Firm*—Handley Law Firm, PLLC

(57) ABSTRACT

A bearing retainer lock (30) for a drawer slide (12) has a detent pin (34) which engages within an opening (38) formed into a forward end (36) of a bearing retainer (26). The detent pin (34) is mounted to the slide member (16) to which the bearing retainer (26) is secured. A slot (60) is formed into the detent pin (34) such that sides of the detent pin (60) have a predetermined flexibility. The opening (38) in the bearing retainer (26) has two side portions (50) which are of selected widths to determine a flexibility of the opening (38). The size and depth of the slot (60) in the detent pin (34) are selected in combination with the width of the side portions (50) of the opening (38) such that the detent pin (34) will engage within and release from the opening (38) at a predetermined force.

17 Claims, 5 Drawing Sheets

DETENT PIN BEARING RETAINER LOCK FOR A DRAWER SLIDE

TECHNICAL FIELD OF THE INVENTION

The present invention relates in general to drawer slides, and in particular to latches for selectively securing various members of drawer slides.

BACKGROUND OF THE INVENTION

Prior drawer slides have been used for slidably securing drawers and equipment chassis' to various types of cabinets, such as equipment racks and the like. The drawer slides have been provided by elongated members having formed edges which are nested together in sliding engagement for telescopically moving between extended and retracted positions. The drawer slides are typically mounted within a cabinet in a spaced apart alignment for securing to opposite sides of a chassis, or drawer, so that the chassis is moveable outward of the cabinet supported in a cantilevered arrangement. Various drawer slide locks have been provided for securing the drawer slides in extended positions, both to prevent the chassis from being pushed back into the cabinet and to prevent inadvertent disassembly of the drawer slides. Some drawer slides have chassis members which are removable from intermediate or cabinet members. When bearing drawer slides are used, such as the type which have bearings which extend between the chassis and intermediate or cabinet members, a bearing retainer is provided to keep the bearings in a spaced apart alignment. When removable chassis members are reinserted back into an intermediate or cabinet member, it is often difficult to fit of the rearward end of the chassis member within the bearings held in place by the bearing retainer. Often, the bearing retainer is of a light weight material which may be easily damaged if excessive force is applied to try to push the chassis member back within the bearing retainer. Additionally, the bearings and bearing retainer will tend to move rearward when the chassis member is inserted between the forward bearings held in place by a forward end of the bearing retainer. It is advantageous to secure the bearing retainer in a desired position until the chassis member is inserted into at least a portion of the forward end of the bearing retainer.

Some prior art drawer slide locks have been provided for securing the bearing retainer in a forward position with an intermediate or cabinet member as a chassis member is inserted therein. Such prior art locks have included spring type locks which engage within adjacent openings in the forward end of the bearing retainer, and also having intermating detents formed into the web of the intermediate or cabinet member, and the bearing retainer which inter-engage to latch the bearing retainer in position for insertion of the chassis member.

SUMMARY OF THE INVENTION

A lock for a bearing retainer of a drawer slide is provided by a detent pin which engages within a opening formed into the bearing retainer. A first end of the detent pin is mounted to the slide member to which the bearing retainer is slidably secured. A second end of the detent pin is preferably provided with sides having a predetermined flexibility by forming a slot which extends longitudinally into the second end of the detent pin. The size and depth of the slot is determined in combination with the thickness of the detent pin to determine a flexibility for sides of the detent pin which engage within the opening formed into the bearing retainer. The opening in the bearing retainer is preferably provided by an elongate aperture extending into a forward edge of a web portion of the bearing retainer. The opening has a tapered entrance section and a retainer section. Two portions of the web of the bearing retainer define sidewalls of the opening, and are of selected width to determine the flexibility of the sidewalls of the opening. The width of the two side portions of the bearing retainer which define opposite edges of the opening are determined by forming apertures through the web portion of the forward end of the bearing retainer, adjacent to the two side portions. The size and depth of the slot in the detent pin are selected in combination with the width of the sidewalls of the opening formed into the bearing retainer such that the detent pin will engage within and release from within the opening at a predetermined range of force, preferably between three to four pounds.

DESCRIPTION OF THE DRAWINGS

For a more complete understanding of the present invention and the advantages thereof, reference is now made to the following description taken in conjunction with the accompanying Drawings in which

FIG. 1 is an exploded, perspective view of a forward portion of the drawer slide having the detent pin lock and the one-time lock for a bearing retainer made according to the present invention;

FIG. 2 is a side elevation view of a forward portion of the drawer slide;

FIG. 3 is an exploded, perspective view of a forward end portion of an intermediate slide member showing the various components of the detent pin lock and the one-time lock;

FIG. 4 is a partial enlargement of the exploded, perspective view of FIG. 3;

FIGS. 5 and 6 are a perspective view and a side elevation view, respectively, of a detent pin used in the detent pin lock;

FIGS. 7 and 8 are a perspective view and a side elevation view, respectively, of a plunger used in the one-time lock;

FIG. 9 is a partial section view of the drawer slide, taken along Section Line 9-9 of FIG. 2, and shows operation of the one-time lock;

FIG. 10 is a sectional view of the drawer slide, taken along Section Line 10-10, and shows installation of the plunger of the one-time lock;

FIG. 11 is an exploded, perspective view of a forward end portion of an intermediate slide member showing the various components of an alternative detent pin lock; and FIGS. 12 and 13 are a perspective view and a side elevation view, respectively, of an alternative detent pin used in the alternative detent pin lock.

DETAILED DESCRIPTION OF THE INVENTION

Figure 1:
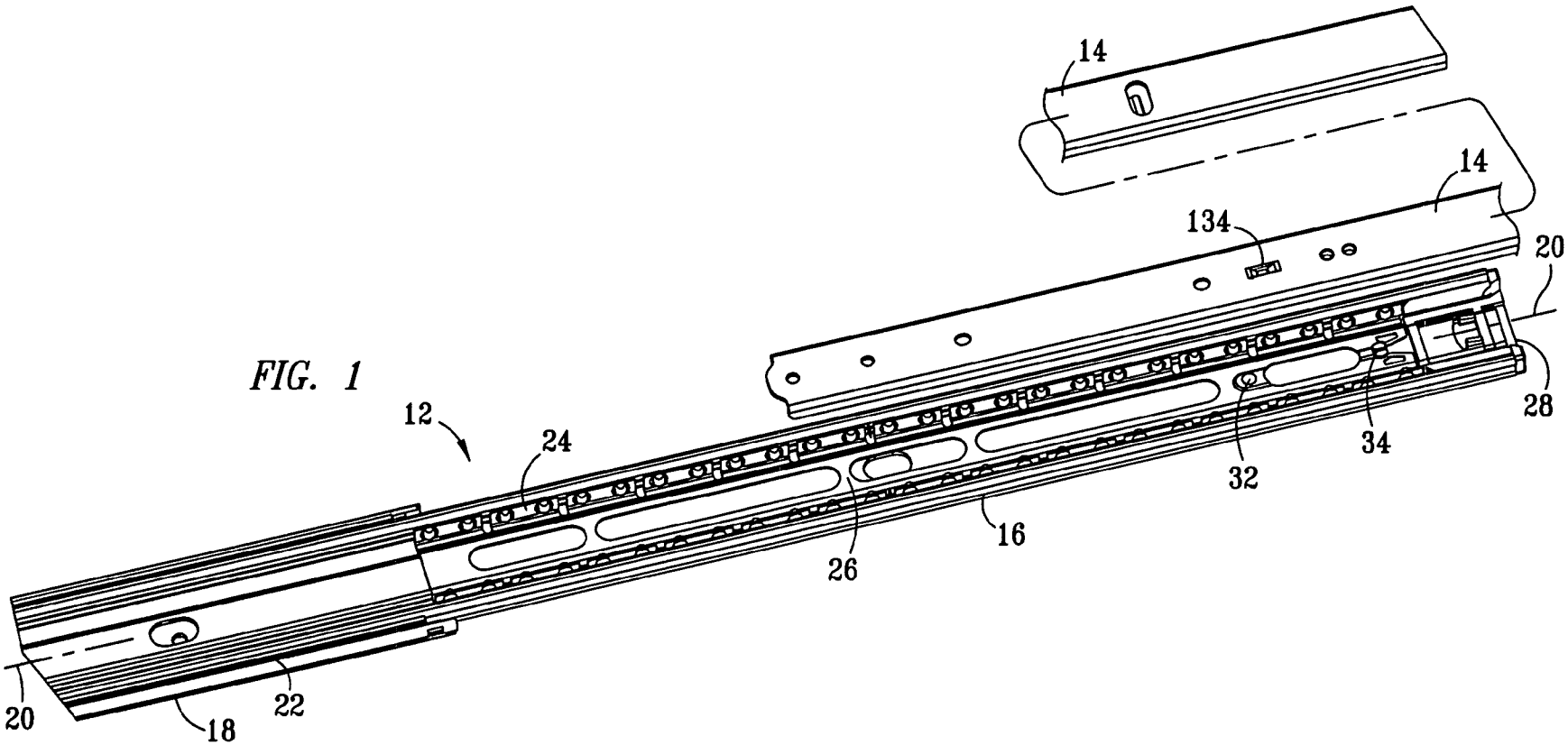
FIGS. 1 through 13 show various aspects for a detent pin bearing retainer lock and a one-time earing retainer lock for a drawer slide made according to the present invention, as set forth below.

FIG. 1 is an exploded, perspective view of a forward portion of the drawer slide 12 having the detent pin lock 30 and the one-time lock 32 used for securing a bearing retainer in a forward position within an intermediate member 16 of the drawer slide 12. The drawer slide 12 has a chassis or drawer member 14, the intermediate member 16 and a cabinet member 18. The chassis member 14 and the intermediate member 16 are slidably extensible from within the cabinet member 18 along the longitudinal axis 20 of the drawer slide 12. The drawer slide 12 is preferably a bearing type drawer slide having bearings 22 (not shown) for slidably supporting the intermediate member 16 within the cabinet member 18, and bearings 24 for slidably supporting the chassis member 14 within the intermediate member 16. A bearing retainer 26 is slide member which is provided for maintaining the bearings 24 in a spaced apart alignment along the edges of the intermediate member 16. A lead guide 28 is provided in the forward end of the intermediate member 16 for guiding the chassis member 14 as the chassis member 14 is inserted within the intermediate member 16. It should be noted that although the slide 12 is shown in the preferred embodiment as a three part drawer slide, other embodiments may be a two part drawer slides such that the intermediate member 16 as used herein, is interchangeable with the cabinet member 18. A detent pin 34 is shown on the forward end of an outward side of the intermediate member 16 and is part of the detent pin bearing retainer lock 30.

Figure 2:
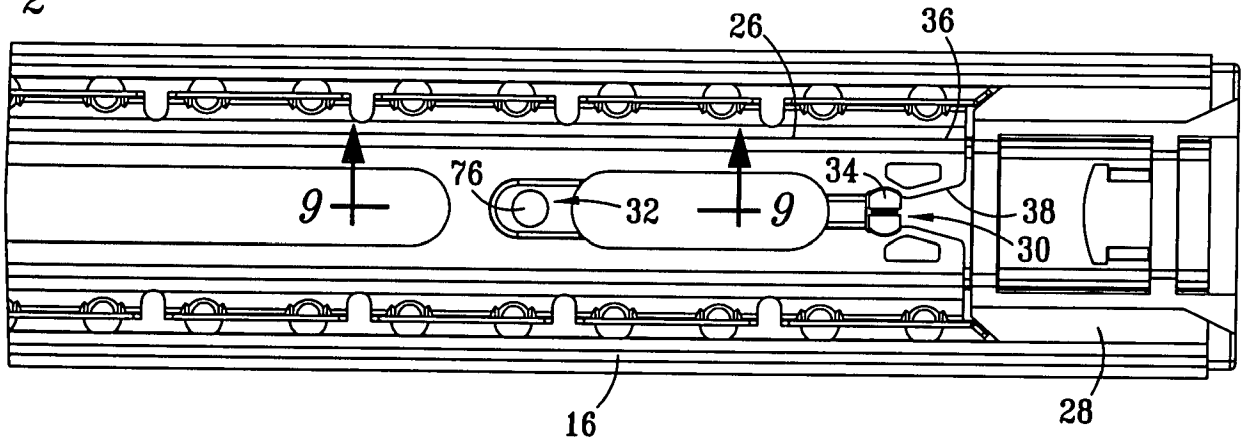

FIG. 2 is a side elevation view of a forward portion of the drawer slide 16, showing the bearing retainer 26 locked into a forward position by the detent pin 34. As shown in FIG. 2, the bearing retainer 26 has been moved forward such that the opening 38 has engaged the detent pin 34, pressing the end portions of the detent pin 34 on opposite sides of a slot 60 (shown in FIG. 5) inward and flexing the flexible side portions 50 (shown in FIG. 4) adjacent to the opening 38 inward such that the detent pin 34 will be secured within the retainer section 42 (shown in FIG. 4). Rearward force on the bearing retainer 26 caused by inserting the chassis member 14 within bearing retainer 26, after insertion of the chassis member 14 for approximately a few inches to a third of the length of the bearing retainer 26, will preferably generate sufficient force of three to four pounds to release the opening 38 of the bearing retainer 26 from engaging the detent pin 34.

Figure 3:
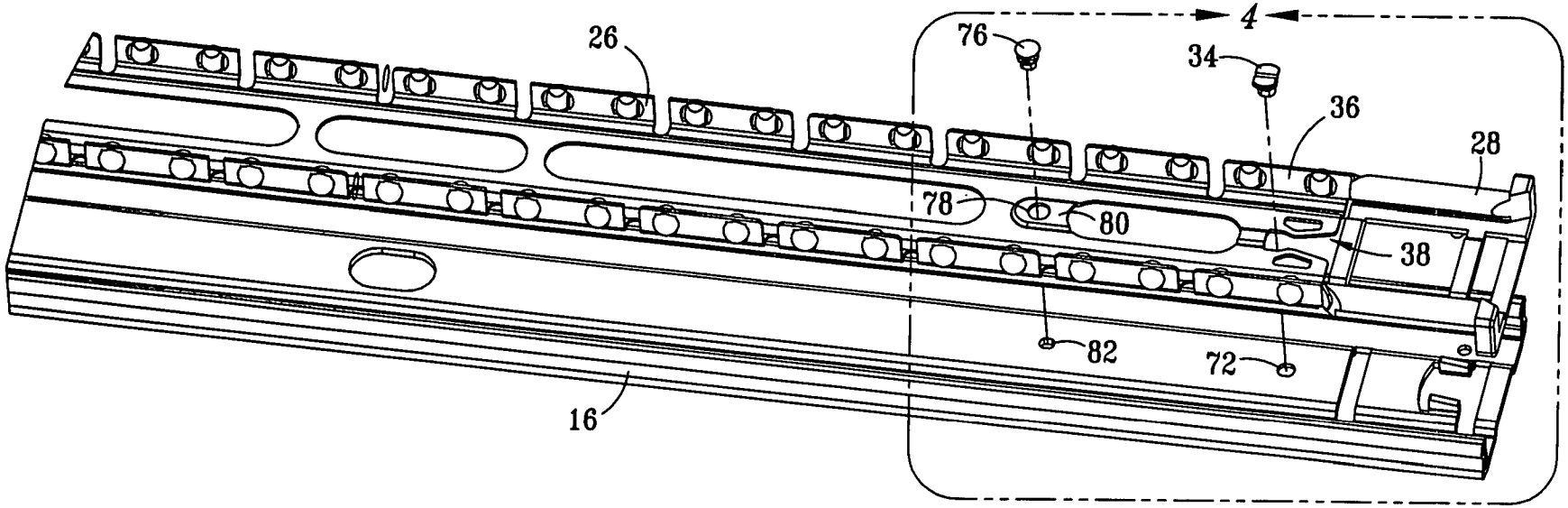
Figure 4:
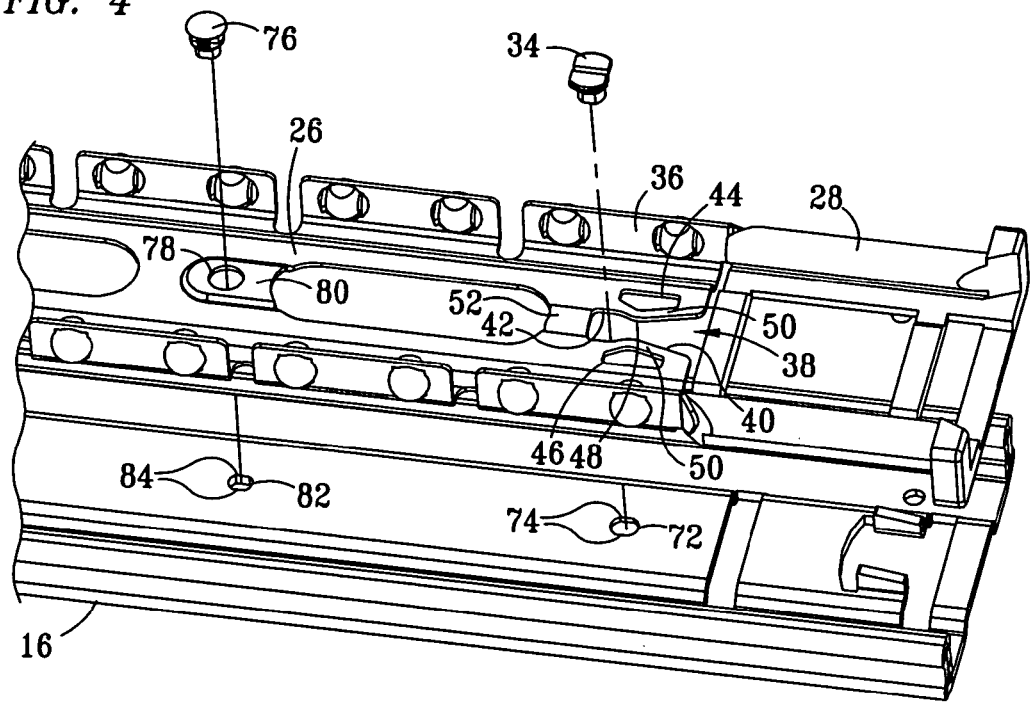

FIG. 3 is an exploded, perspective view of a forward end portion of an intermediate slide member 16 showing the various components of the detent pin lock 30 and the one-time lock 32, and FIG. 4 is a partial enlargement of the exploded view of FIG. 3. The opening 38 is formed into the forward end 36 of the bearing retainer 26 extends to the region 52 of the bearing retainer 26. Two side portions 50 of the bearing retainer 26 define opposite edges of the opening 38. The opening 38 has a tapered entrance section 40 and a retainer section 42. Apertures 44 and 46 are formed on opposite sides of the opening 38 adjacent a grip portion 48 of the opening 38. The grip portion 48 is disposed between the tapered entrance section 40 and the retainer section 42, and defines protuberances from the side portions 50 on opposite sides of the opening 38 for securing the detent pin 34 within the retainer section 42. The opening 38 at the grip portion 48 is sized to be slightly smaller than the thickness of the detent pin 34 to provide a press fit for securing the detent pin 34 within the retainer section 42 of the opening 38. The apertures 44 and 46 are disposed adjacent the opening 38, and spaced apart therefrom to define flexible side portions 50 on opposite sides of the opening 38. The width of the side portions 50 may be determined by the size and placement of the apertures 44 and 46, such that the amount of force required to push the flexible side portions 50 adjacent to the opening 38 inward to widen the spacing of the opening 38 at the grip portion 48 may be predetermined according to generally defined engineering principles.

Figure 5:
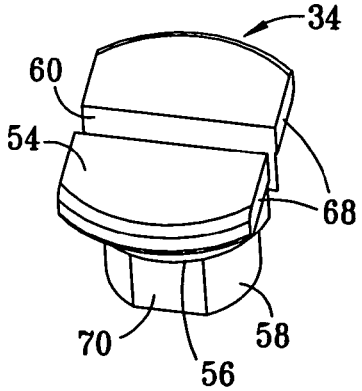
Figure 6:
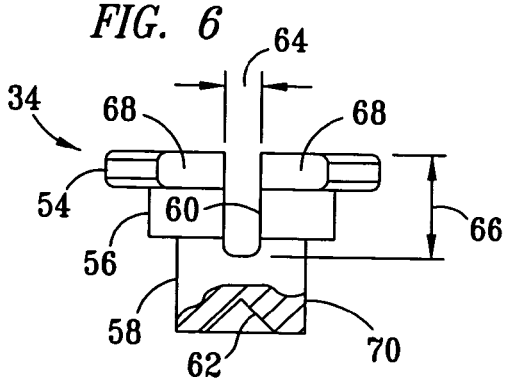

FIG. 5 is a perspective view and FIG. 6 is a side elevation view of a detent pin 34 of the detent pin bearing retainer lock 30 made according to the present invention. The detent pin 34 has a head 54, a grip region 56 and a shank portion 58. The grip region 56 may be defined as part of the shank portion 58 or the head 54, or as a separate region there-between. The grip region 56 engages within the flexible side portions 50 of the forward end 36 of the bearing retainer 26, passing between the grip portion 48 to secure the detent pin 34 within the retainer section 42 of the opening 38. A slot 60 is provided by an opening which extends longitudinally into the top of the head 54 of the detent pin 34, traverses the grip portion 56 and extends partially into the shank portion 58. The slot 60 provides an aperture which extends through the head portion 54 and the grip region 56, and into the shank portion 58, such that opposite sides of the head 54 and the grip region 56 define protuberances, or fingers, which may be flexed inward at a force which may be determined by general engineering principles. In other embodiments, the slot 60 may extend upward from the bottom of the shank portion 58 and through the grip region and partially into the head 54. In other embodiments, rather than the slot 60, an aperture (not shown) may extend into the detent pin 34 in the grip region 56, such as a hole which extends in either a longitudinal direction or a transverse direction to the longitudinal axis of the detent pin 34. A bore 62 extends into the lower portion of the shank portion 58. The width 64 of the slot 60 and the depth 66 of the slot 60 are determined, in combination with the structural strength of the flexible side portions 50 of the forward end 36 of the bearing retainer 26, such that the bearing retainer will release at a pressure of a force which is not substantially more than five pounds, and preferably a force of three to four pounds pushing rearward on the bearing retainer 26 relative to the intermediate member 16.

Figure 7:
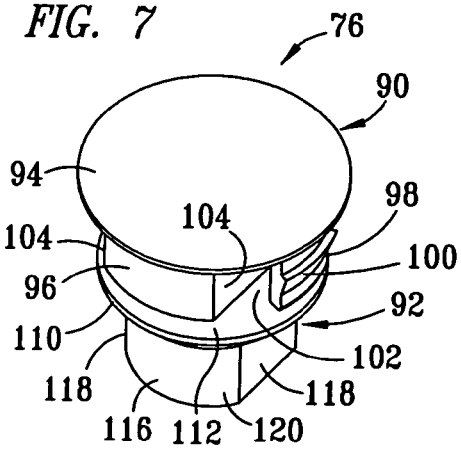
Figure 8:
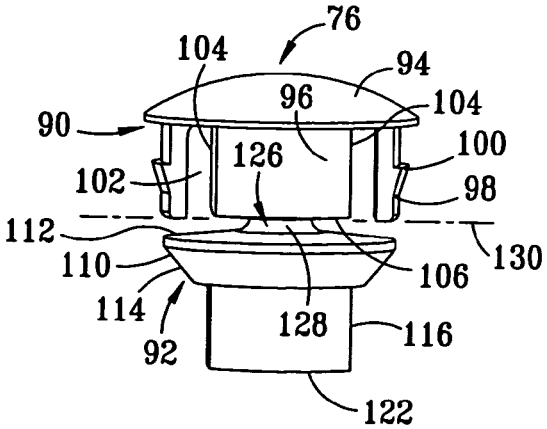

FIGS. 7 and 8 are a perspective view and a side elevation view, respectively, of a plunger 76 used in the one-time lock 32. The plunger 76 is preferably a single, integrally formed, solid member having a first portion 90 and a second portion 92. The plunger 76 is preferably molded of plastic material, such as polycarbonate. The first portion 90 of the plunger 76 has a head 94 and a shank 96. Two oppositely facing retainer tabs 98 extend downward, as viewed in FIGS. 7 and 8, from underneath opposite sides of the head 94. The two retainer tabs 98 extend parallel to the longitudinal length of the plunger 76, spaced apart by a space 102 from two flats 104 formed on the shank 96. The two retainer tabs 98 and the shank 96 of the first portion 90 extend downward to a plane defined by a break line 130 in FIG. 8. The two retainer tabs 98 each have a protrusion 100 which extends outward, on opposite sides of the respective retainer tabs 98 from the shank 96. The protuberances 100 have tapered lower shoulders to aid in insertion into the aperture 78 in the bearing retainer 26, and squared upper shoulders which are spaced apart from the underside of the head 94 of the first portion 90 for securing the thickness of a web portion of the retainer member 26. The bottom, or underside, of the shank 96 preferably has a planar surface 106.

The second portion 92 of the plunger 76 is preferably has a head 110 and a shank 116. The head 110 has a substantially planar upper surface 112 and a tapered lower surface 114, tapering to a smaller diameter from the upper surface 112 toward the shank 116. The tapered lower surface 114 is provided for snugly securing the shank 116 of the second portion 92 in the aperture 82 (shown in FIG. 4) in the intermediate member 16, accounting for tolerances in sizes of the aperture 82, and then heat staking the shank 116 into the aperture 82 in the intermediate member 16 to rigidly secure the shank 116 of the second portion 92 to the intermediate member 16. Prior to severing the first portion 90 from the second portion 92, heat staking the shank 116 to the intermediate member 16 rigidly secures the first portion 90 to the intermediate member 16. The shank 116 has two oppositely facing, rounded sides 116 and two oppositely facing flats 118 which fit within the aperture 82 (shown in FIG. 4) with the flats 118 of the second portion 92 fitting against the flats 84 of the aperture 82, keying the shank 96 into the aperture 82 to fixedly secure the first portion 90 and the second portion 92 in fixed angular relation to the intermediate member 16.

A connecting portion 126 extends between the planar underside surface 106 of the shank 96 and the substantially planar upper surface 112 of the head 110 of the second portion 92. The connecting portion provides a frangible portion of the plunger 76 for securing the first portion 90 to the second portion 92, until the first portion 90 is broken from the second portion 92 by insertion of the chassis member 14 into the bearing retainer 26. The connecting portion 126 has tapered surface 128, tapering to a smaller size in extending from planar upper surface 112 of the head 110 of the second portion 92 to the planar lower surface 106 of the shank 96 of the first portion 90. The tapered surface 128 provides a weak point at the planer underside 106 of the shank 96 of the first portion 90, such that impact to the first portion 90 of the plunger 76 will cause the first portion 90 to shear from the connecting portion 126.

Figure 9:
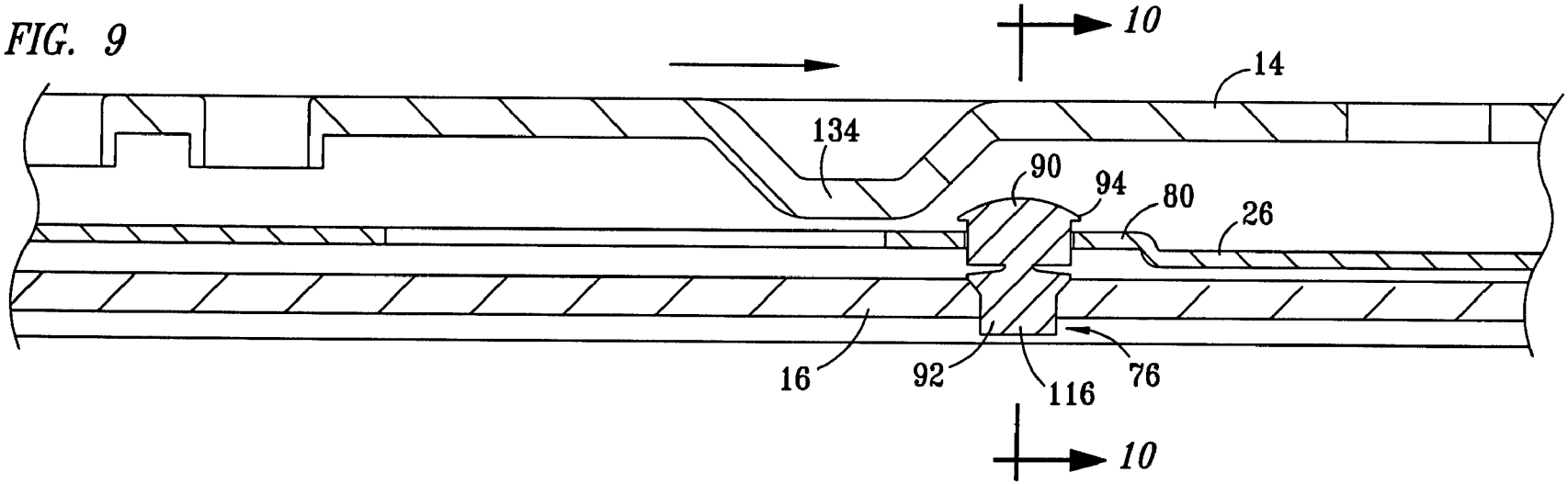

FIG. 9 is a partial section view of the drawer slide 12, taken along Section Line 9-9 of FIG. 2, and shows operation of the one-time lock 32 as the emboss 134 in the chassis member 14 is approaching the head 94 of the plunger 76. Prior to inserting the chassis member 14 within the bearing retainer 26 and the intermediate member 16, the plunger 76 has been installed to retain the bearing retainer 26 in a fixed position relative to the intermediate member 16. The plunger 76 is installed by passing the shank 116 of the second portion 92 through the aperture 78 (shown in FIG. 4) in the bearing retainer 26 and then through the aperture 82 (shown in FIG. 4) in the intermediate member 16. The shank 116 is then heat staked to the intermediate member 16, such that the plunger 76 is fixedly secured to the intermediate member 16. The head 94 of the first portion 90 of the bearing retainer 26 is spaced apart from the surface of an emboss 80 in the bearing retainer 26, such that the protrusions 100 of the retainer tabs (shown in FIG. 9) are not located on an opposite side of the emboss 80 from the head 94. Preferably, the protrusions 100 will be disposed either within or slightly above the aperture 78, ready for passing outward of the opposite side of the aperture 78 from the head 94. Prior to inserting the chassis member 14 into the bearing retainer 26, the first portion 90 at least partially extends through the aperture 78 in the emboss 80 (shown in FIG. 4).

Figure 10:
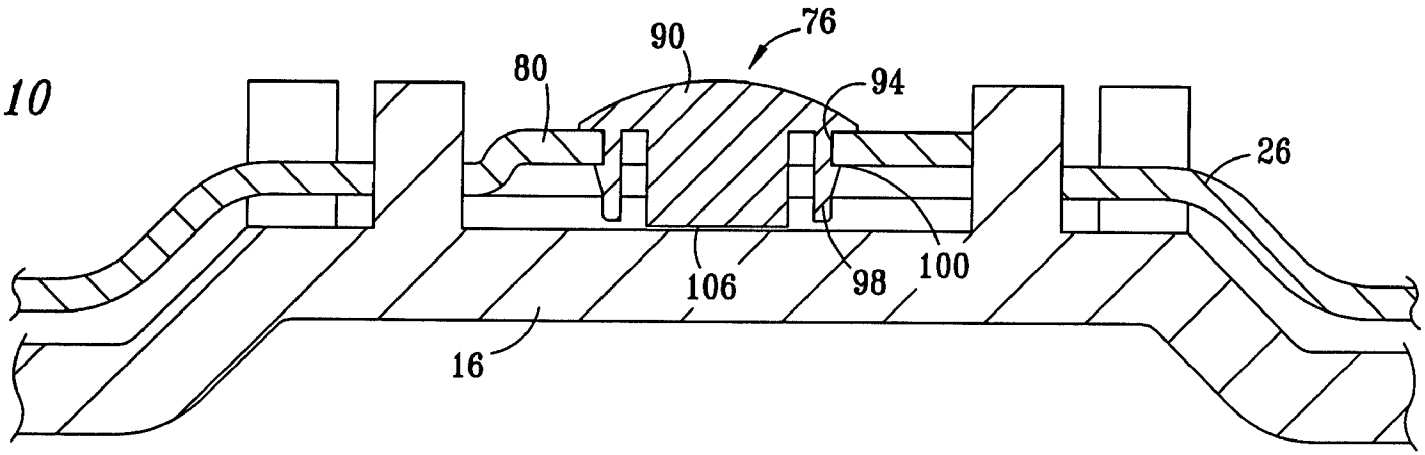

Inserting the chassis member 14 into the bearing retainer 26 and the intermediate member 16 will move the emboss 134 into and across the rounded head 94 of the upper portion 90 of the plunger 76. Since the second portion of the plunger 76 is fixedly secured to the intermediate member 16, and the rounded end of the head 94 is disposed directly in the path of the emboss 134, force applied to move the chassis member 134 into the plunger 76 will cause the first portion 90 of the plunger 76 to shear from the second portion 92 along a plane defined by the shear line 130 (shown in FIG. 8). Then, the emboss 134 passing across the head 94 will push the first portion fully into the aperture 78 in the emboss 80 of the bearing retainer 26, passing the protrusions 100 onto an opposite side of the emboss 80 from the head 94 and locking the first portion 90 into the emboss 80 of the bearing retainer 26, as shown in FIG. 10. The bearing retainer 26 will then be free to slidably move relative to the intermediate member 16.

FIG. 10 is a sectional view of the drawer slide 12, taken along Section Line 10-10 of FIG. 9, and shows the plunger 76 of the one-time lock 32 after the first portion 90 has been sheared from the second portion 92 (shown in FIG. 9). The head 94 is shown disposed directly against one side of the emboss 80 of the bearing retainer 26, with the protrusions 100 disposed directly against the other side of the emboss 80. The retainer tabs 98 are preferably formed of resilient materials, such that the protrusions 100 will move outward after passing from within the aperture 78 (shown in FIG. 4), locking the thickness of the emboss 80 between the protrusions 100 and the head 94 and securing the upper portion 90 of the plunger 76 to the emboss 80. The upper portion 90 has sheared from the lower portion 92 (shown in FIG. 9) such that the lower surface 106 of the upper portion 90 is flat, or planer, and spaced apart from the intermediate member 16 such as not to interfere with movement of the bearing retainer 26 relative to the intermediate member 16.

Figure 11:
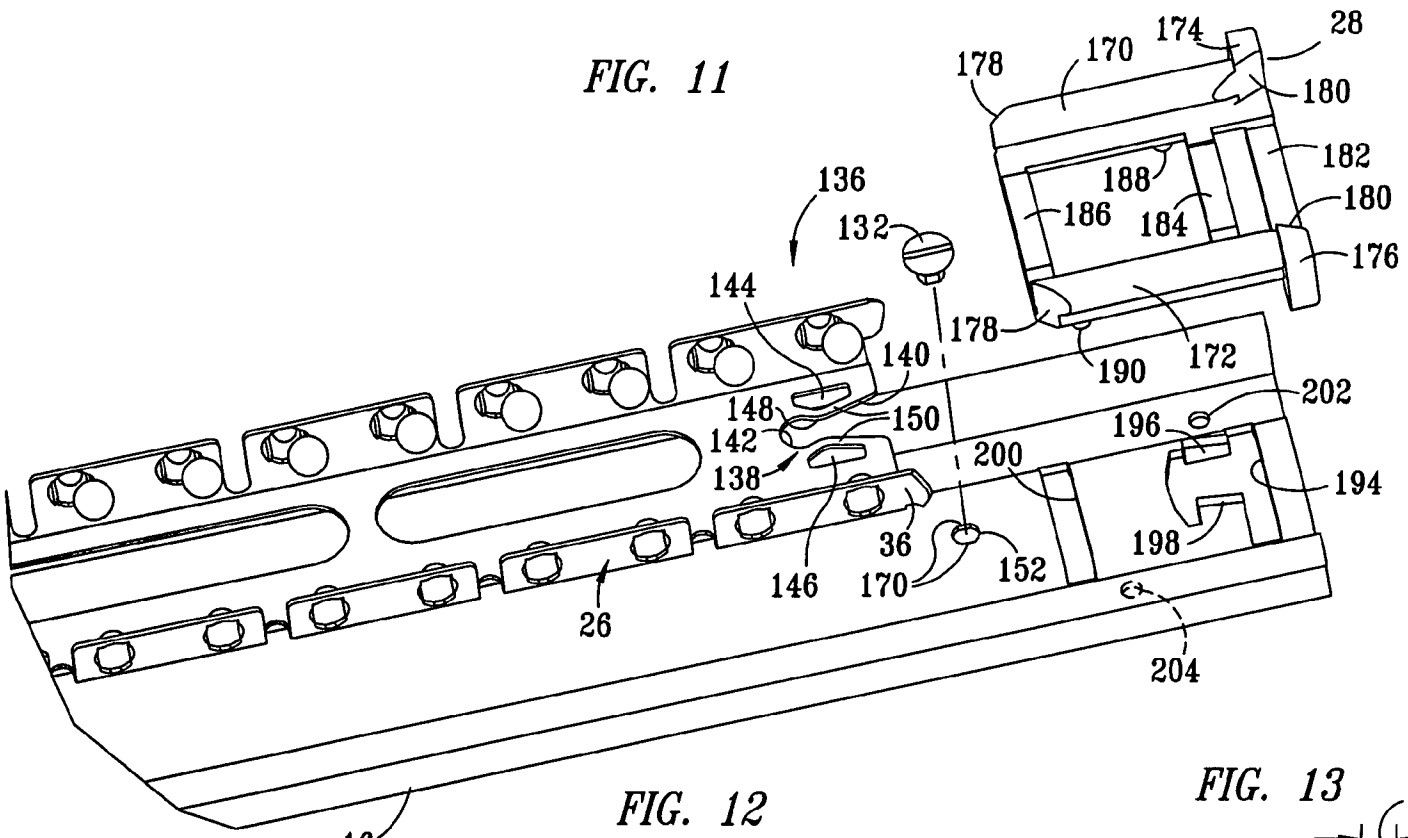

FIG. 11 is an exploded, perspective view of a forward end portion of the intermediate slide member 16 showing the various components of an alternative detent pin lock 136. An opening 138 is formed into the forward end of the bearing retainer 26. The opening 138 has a tapered entrance section 140, and a retainer section 142. Apertures 144 and 146 are formed on opposite sides of the opening 138 adjacent a grip portion 148 of the opening 138. The grip portion 148 is disposed between the tapered entrance section 140 and the retainer section 142 and provides protuberances which extend into the opening 138 for securing the detent pin 132 within the retainer section 142. The opening 138 at the grip portion 148 is sized to be slightly smaller than the thickness of the detent pin 132 to provide a press fit for securing the detent pin 132 within the retainer section 142 of the opening 138. Two side portions 150 of the bearing retainer 26 define opposite edges of the opening 138. The apertures 144 and 146 are disposed adjacent the opening 138, and spaced apart therefrom to define the flexible side portions 150. The width of slide portions 150 may be determined by the size and placement of the apertures 144 and 146, such that the amount of force required to push the flexible side portions 150 adjacent to the opening 138 inward may be predetermined according to generally defined engineering principles.

The lead guide 28 has edge members 170 and 172 with forwardly disposed tabs 174 and 176 which engage within the side rails of the intermediate member 16. Chamfers 178 are provided on the outward and rearward edges of the edge members 170 and 172 for engaging with outwardly extended flanges of the forward end 36 of the bearing retainer 26. A tapered entrance portion 180 is provided on the inward sides of the edge members 170 and 172, in the forward end of the edge members 170 and 172, for guiding a chassis member 14 when being inserted within the intermediate member 16 in the bearing retainer 26. The lead guide 28 further includes cross-members 182, 184 and 186. Heat stake tabs 188 and 190 are provided for heat staking to apertures 202 and 204 in the forward end of the intermediate member 16. An aperture 194 is formed into the forward end of the intermediate member 16 and has a profile for receiving the cross-member 182, the aperture 194. An aperture 200 is provided for receiving the cross-member 186. Two tabs 196 and 198 are provided adjacent the profile of the aperture 194 for being received between the cross-members 182 and 184.

Figure 12:
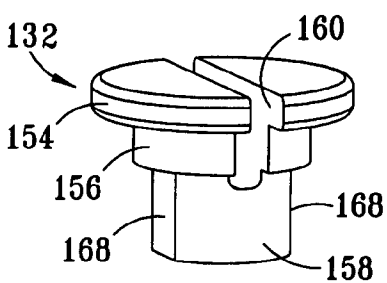
Figure 13:
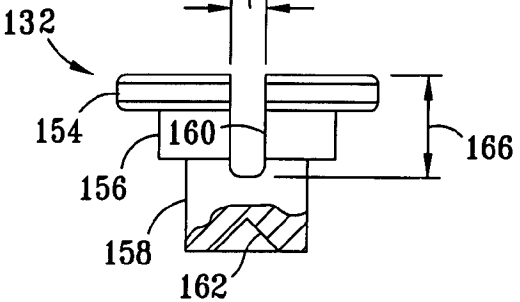

FIG. 12 is a perspective view and FIG. 13 is a side elevation view of the alternative detent pin 132 of the alternative detent pin 132 of the bearing retainer lock 136. The detent pin 132 has a head 154, a grip region 156 and a shank portion 158. The grip region 156 may be defined as part of the shank portion 158 or the head 154, or a separate region there-between. The grip region 156 engages within the flexible side portions 150 of the forward end of the bearing retainer 26, passing between the grip portion 148 to secure the detent pin 132 within the retainer section 142 of the opening 138. A slot 160 is provided by an opening, or aperture, which extends longitudinally into the top of the head 154 of the detent pin 132, traverses the grip portion 156 and extends partially into the shank portion 158. The slot 160 extends through the head portion 154 and the grip region 156, and into the shank portion 158, such that opposite sides of the head 154 and the grip region 156 define protuberances, or fingers, which may be flexed inward at a force which may be determined by general engineering principles. In other embodiments, the slot may extend upward from the bottom of the shank portion 158 and through the grip region and partially into the head 154. In yet other embodiments, rather than the slot 160, an aperture (not shown) may extend into the detent pin 132, such as into the grip region 56 in a direction transverse to the longitudinal axis of the detent pin 132. A bore 162 extends into the lower portion of the shank portion 158. The width 164 of the slot 160 and the depth 166 of the slot 160 are determined, in combination with the structural strength of the flexible side portions 150 of the forward end of the bearing retainer 26, such that the bearing retainer 26 will release at a pressure of a force which is not substantially more than five pounds, and preferably a force of three to four pounds pushing rearward on the bearing retainer 26 relative to the intermediate member 16.

The present invention has several advantages over prior art bearing retainer locks. A lock according to the present invention may be provided by an elongate opening, such as a slot, which extends into a forward edge of a bearing retainer and a resilient detent pin, in which resiliency of the sidewalls of the slot and resiliency of the detent pin are selected for releasing at a predetermined force. Apertures may be provided in portions of the bearing retainer adjacent the slot to provide a selected width of the portion of the bearing retainer adjacent to the opening and a slot of a selected size may be formed into the detent pin to determine the resiliency of the detent pin according to general engineering principals, such that the detent pin will release from within the slot in the bearing retainer at the predetermined force. It should also be noted that a release member mounted to the chassis member to release the bearing retainer from being secured upon the detent pin is not required, since friction from inserting the chassis member within the bearing retainer generates sufficient force to release the bearing retainer from engaging with the detent pin.

A one time lock is provided for securing a bearing retainer to an intermediate member. The one time lock comprises a plunger having a first portion, a second portion, and a frangible portion which secures the first and second portion in fixed relation. The second portion is fixedly secured to the intermediate member. The first portion of the plunger is secured to the second portion by the frangible portion, such that the first portion extends through an aperture in the bearing retainer, preventing the bearing retainer from sliding relative to the intermediate member. The first portion has locking tabs which extend from a head of the first portion, toward the second portion and partially into the bearing retainer. Insertion of a chassis member fractures the frangible portion connecting the first portion to the second portion, releasing the bearing retainer to slidably move relative to the intermediate member and fully inserting the first portion into the aperture in the bearing retainer to secure a thickness of the bearing retainer between the head and the locking tabs of the second portion of the plunger, securing the first portion to the bearing retainer.

Although the preferred embodiment has been described in detail, it should be understood that various changes, substitutions and alterations can be made therein without departing from the spirit and scope of the invention as defined by the appended claims.

What is claimed is:

1. A lock on a drawer side, the drawer slide having first and second slide members which are slidably secured together, comprising:

a detent pin mounted to the first slide member, said detent pin having a grip region, a shank portion, and an aperture formed therein, said grip region disposed to one side of said shank portion in a direction orthogonal to a direction of movement of said first slide member relative to said second slide member, wherein said shank portion is secured within a mounting hole formed into said first slide member, and said aperture has a width and a depth which are of selected of sizes to define a predetermined flexibility of at least one portion of said detent pin;

a portion of the second slide member having an opening formed therein, said opening configured with a size and located for slidably receiving said detent pin when the second slide member is moved relative to the first slide member and grippingly engaging said at least one portion of said detent pin to secure said second slide member from moving relative to the first slide member;

wherein said aperture width and said aperture depth of said aperture in said detent pin are sized to at least in part determine a preselected force at which said detent pin releases from within said opening in the second slide member; and wherein said detent pin comprises a head, said shank portion and said grip region, said shank portion securing said detent pin to said first slide member, said head disposed on an opposite side of said second slide member from the first slide member when said detent pin is disposed in the second slide member, and said grip region disposed between said head and said shank portion for engaging said second slide member in said opening.

2. The lock on a drawer slide according to claim 1, further comprising:

the second slide member having at least one side portion defining at least one side of said opening, wherein said at least one side portion is defined to have a predetermined width which defines a flexibility of said at least side portion to at least in part determine said preselected force for release and entry of said detent pin from within said opening in the second slide member; and wherein said width of said at least one side portion of the second slide member is defined by a second aperture formed into the second slide member, adjacent to said at least one side portion.

3. The lock on a drawer slide according to claim 1, further comprising:

the second slide member having two side portions defining opposite sides of said opening, wherein said two side portions are defined to have predetermined widths which define flexibility of said side portions to at least in part determine said preselected force for release and entry of said detent pin from within said opening in the second slide member; and wherein said widths of said two side portions of the second slide member are defined by second and third apertures formed into the second slide member, adjacent to respective ones of said two side portions.

4. The lock on a drawer slide according to claim 1, wherein said opening comprises a tapered entrance section, a grip region and a grip portion disposed between said tapered entrance section and said retainer section, said grip portion being of smaller size than said entrance section and said retainer section of said opening, and said grip region of said detent pin.

5. A lock on a drawer side, the drawer slide having first and second slide members which are slidably secured together, comprising:

a bearing retainer slidably secured within the first slide member and adapted for slidably receiving the second slide member;

a detent pin mounted to the first slide member, said detent pin having a grip region, a shank portion, and a slot formed therein, said slot having a slot width and a slot depth with said slot depth extending from said grip region into said shank portion in a direction orthogonal to a direction of movement of said bearing retainer relative to said first slide member and said slot width extending orthogonal to said slot depth, wherein said slot width and said slot depth are of selected of sizes to define a predetermined flexibility of at least one portion of said detent pin;

said bearing retainer having an opening formed therein, said opening configured with a size and located for slidably receiving said detent pin when said bearing retainer is slidably moved relative to the first slide member and grippingly engaging said at least one side of said detent pin to secure said bearing retainer from moving relative to the first slide member;

wherein said slot width and said slot depth of said slot in said detent pin are sized to at least in part determine a preselected force at which said detent pin releases from within said opening in said bearing retainer;

wherein said detent pin comprises a head, said shank portion and said grip region, said shank portion securing said detent pin to said first slide member, said head disposed on an opposite side of said bearing retainer from the first slide member when said detent pin is disposed in said bearing retainer, and said grip region disposed between said head and said shank portion for engaging said side portions of said opening in said bearing retainer.

6. The lock on a drawer slide according to claim 5, further comprising:

said bearing retainer having at least one side portion defining an edge of said opening, wherein said at least one side portion is defined to have a predetermined width which defines a flexibility of said at least one side portion to at least in part determine said preselected force for release and entry of said detent pin from within said opening in said bearing retainer; and wherein said width of said at least one side portion of said bearing retainer is defined by an aperture formed into said bearing retainer, adjacent to said at least one side portion.

7. The lock on a drawer slide according to claim 5, further comprising:

said bearing retainer having two side portions which define opposite edges of said opening, wherein said two side portions are defined to have predetermined widths which define flexibility of said side portions to at least in part determine said preselected force for release and entry of said detent pin from within said opening in said bearing retainer; and wherein said widths of said side portions of said bearing retainer which define opposite edges of said opening are defined by adjacent apertures formed into said bearing retainer, adjacent to respective ones of said side portions.

8. The lock on a drawer slide according to claim 5, wherein said opening comprises a tapered entrance section, a retainer section and a grip portion disposed between said tapered entrance section and said retainer section, said grip portion being of smaller size than said entrance section and said retainer section of said opening, and said grip region of said detent pin.

9. A lock on a drawer side, the drawer slide having first and second slide members which are slidably secured together, comprising:

a detent pin mounted to the first slide member, said detent pin having a grip region;

a bearing retainer slidably secured within the first slide member and adapted for slidably receiving the second slide member;

said bearing retainer having an opening formed therein, said opening adapted for slidably receiving said grip region of said detent pin when said bearing retainer is slidably moved relative to the first slide member and grippingly engaging said detent pin to secure said bearing retainer from moving relative to the first slide member;

said bearing retainer having a first side portion and a second side portion defining opposite edges of said opening, wherein said first side portion is defined to have predetermined width which defines flexibility of said first side portion to at least in part determine a preselected force for release and entry of said detent pin from within said opening in the bearing retainer, wherein said width of said first side portion is defined by an aperture formed into said bearing retainer adjacent to said first side portion, and said aperture is enclosed within said bearing retainer;

a plunger having a first portion, a second portion, and a frangible portion which secures said first portion and said second portion in fixed relation, wherein said first portion of said plunger is secured within a first plunger opening formed in said bearing retainer and said second portion of said plunger is secured within a second plunger opening formed in the first slide member, such that said bearing retainer is secured in fixed relation to the first slide member;

wherein said frangible portion of said plunger is selectively sheared to release said first portion from said second portion, such that said bearing retainer is slidably moveable relative to the first slide member;

wherein said detent pin comprises a head, a shank portion and said grip region, said shank portion securing said detent pin to said first slide member, said head disposed on an opposite side of said bearing retainer from the first slide member when said detent pin is disposed in the bearing retainer, and said grip region disposed between said head and said shank portion for engaging said side portions of said opening in said bearing retainer; and said detent pin having a slot formed therein and extending in said grip region to define a predetermined flexibility of said grip region of said detent pin.

10. The lock on a drawer slide according to claim 9, wherein said opening comprises a tapered entrance section, a retainer section and a grip portion disposed between said tapered entrance section and said retainer section, said grip portion being of smaller size than said entrance section, said retainer section of said opening, and a grip region of said detent pin.

11. The lock on a drawer slide according to claim 10, wherein said second side portion has a second predetermined width defines a predetermined flexibility of said second side portion to at least in part determine a preselected force for release and entry of said detent pin from within said opening in said bearing retainer, wherein said second width of said second side portion is defined by a second aperture formed into said bearing retainer, adjacent to said second side portion.

12. The lock on a drawer slide according to claim 9, wherein said slot in said detent pin extends through said head, through said grip region and into said shank portion of said detent pin.

13. The lock on a drawer slide according to claim 12, wherein said grip region is defined by an end of said shank portion of said detent pin, said first portion of said plunger has a head and locking tabs of elongate shape with protuberances extending outward from said locking tabs, and said locking tabs extend from said head of said first portion of said plunger toward said second portion of said plunger and into said bearing retainer, with said protuberances disposed between said head of said first portion and said bearing retainer when said frangible portion secures said first portion in fixed relation to said second portion, wherein said second portion is secured in fixed relation to the first slide member such that forces urging movement of the second slide member relative to the first slide member fractures said frangible portion connecting said first portion of said plunger to said second portion of said plunger, releasing said bearing retainer to slidably move relative to the first slide member and fully inserting said first portion of said plunger into said first plunger aperture in said bearing retainer to secure a thickness of said bearing retainer between said head and said protuberances of said locking tabs of said first portion of said plunger and thereby secure said first portion of said plunger from moving relative to said bearing retainer.

14. The lock on a drawer slide according to claim 1, further comprising:

a plunger having a first portion, a second portion, and a frangible portion which secures said first portion and said second portion in fixed relation, wherein said first portion of said plunger extends through a first plunger opening formed in the second slide member and said second portion of said plunger is secured within a second plunger opening formed in the first slide member, such that the second slide member is secured in fixed relation to the first slide member, and a protuberance of said first portion of said plunger extends from said first portion between a head of said first portion, with both said head and said protuberance disposed on one side of said first plunger opening; and wherein said frangible portion of said plunger is selectively sheared to release said first portion from said second portion, such that the second slide member is slidably moveable relative to the first slide member and said first portion is pushed fully into said first plunger opening, with said first plunger opening disposed between said head and said protuberance of said first portion to retain said first portion in said fixed relation relative to said second slide member.

15. The lock on a drawer slide according to claim 14, further comprising said first portion of said plunger having said head and locking tabs of elongate shape, said locking tabs extending from said head of said first portion of said plunger toward said second portion of said plunger and into the second slide member for securing said first portion of said plunger to the second slide member when said first portion is fully inserted into said first plunger opening, and wherein said protuberance extends from said locking tabs.

16. The lock on a drawer slide according to claim 5, further comprising:

a plunger having a first portion, a second portion, and a frangible portion which secures said first portion and said second portion in fixed relation, wherein said first portion of said plunger is secured within a first plunger opening formed in said bearing retainer and said second portion of said plunger is secured within a second plunger opening formed in the first slide member, such that said bearing retainer is secured in fixed relation to the first slide member; and wherein said frangible portion of said plunger is selectively sheared to release said first portion from said second portion, such that said bearing retainer is slidably moveable relative to the first slide member.

17. The lock on a drawer slide according to claim 16, further comprising said first portion of said plunger having a head and locking tabs of elongate shape with protuberances extending outward from said locking tabs, said locking tabs extending from said head of said first portion of said plunger toward said second portion of said plunger and into said bearing retainer, with said protuberances disposed between said head of said first portion and said bearing retainer when said frangible portion secures said first portion in fixed relation to said second portion, wherein said second portion is secured in fixed relation to the first slide member such that forces urging movement of the second slide member relative to the first slide member fractures said frangible portion connecting said first portion of said plunger to said second portion of said plunger, releasing said bearing retainer to slidably move relative to the first slide member and fully inserting said first portion of said plunger into said first plunger aperture in said bearing retainer to secure a thickness of said bearing retainer between said head and said protuberances of said locking tabs of said first portion of said plunger and thereby secure said first portion of said plunger to said bearing retainer; and wherein said second portion is secured in fixed relation to the first slide member such that movement of the second slide member relative to the first slide member fractures said frangible portion connecting said first portion of said plunger to said second portion of said plunger, releasing said bearing retainer to slidably move relative to the first slide member and fully inserting said first portion of said plunger into said first plunger aperture in said bearing retainer to secure a thickness of said bearing retainer between said head and said protuberances of said locking tabs of said first portion of said plunger and thereby secure said first portion of said plunger to said bearing retainer.

* * * * *